US010370225B2

(12) United States Patent
Miles

(10) Patent No.: US 10,370,225 B2
(45) Date of Patent: Aug. 6, 2019

(54) LOAD LINE GUIDE

(71) Applicant: Altec Industries, Inc., Birmingham, AL (US)

(72) Inventor: Johnson X. Miles, Roanoke, VA (US)

(73) Assignee: Altec Industries, Inc., Birmingham, AL (US)

( * ) Notice: Subject to any disclaimer, the term of this patent is extended or adjusted under 35 U.S.C. 154(b) by 508 days.

(21) Appl. No.: 14/969,973

(22) Filed: Dec. 15, 2015

(65) Prior Publication Data

US 2017/0166424 A1 Jun. 15, 2017

(51) Int. Cl.
*B66C 23/62* (2006.01)

(52) U.S. Cl.
CPC ..... *B66C 23/62* (2013.01)

(58) Field of Classification Search
USPC ..... 254/388, 389
See application file for complete search history.

(56) References Cited

U.S. PATENT DOCUMENTS 2,997,683 A * 8/1961 Koenig ..... H01Q 9/10 439/412
3,250,400 A 5/1966 Bennett
3,256,633 A * 6/1966 Smith ..... A01K 87/00 43/25
3,638,806 A * 2/1972 Hippach ..... B66C 23/703 212/231
4,407,089 A * 10/1983 Miller ..... A01K 97/10 43/21.2
4,550,970 A * 11/1985 Ogino ..... H01R 4/38 439/411
5,137,120 A * 8/1992 Barbosa ..... F16D 65/22 188/106 A
7,216,716 B2 5/2007 Cole et al.
2003/0136323 A1* 7/2003 Cudd, III ..... B63H 9/1021 114/105
2015/0345589 A1* 12/2015 Fuke ..... B66C 23/26 24/115 K

* cited by examiner

*Primary Examiner* — Michael R Mansen
*Assistant Examiner* — Juan J Campos, Jr.
(74) *Attorney, Agent, or Firm* — Erise IP, P.A.

(57) ABSTRACT

A load line guide is configured to direct a load line of an crane along a boom assembly, the load line guide comprising a guide housing and a first guide cam. The guide housing presents a gap oriented in a lateral direction and a channel oriented in a longitudinal direction. The first guide cam is pivotably secured to the guide housing and disposed in the gap. The first guide cam is configured to be selectively placed into an open position and a closed position. While the first guide cam is in the open position, the load line guide is configured to receive the load line into the channel of the guide housing; and while the first guide cam is in the closed position, the guide housing is configured to retain the load line guide within the channel of the guide housing.

14 Claims, 5 Drawing Sheets

LOAD LINE GUIDE

BACKGROUND

1. Field

Embodiments of the invention relate to cranes and their implements. More specifically, embodiments of the invention relate to the routing and support of load lines configured to support a load from the crane.

2. Related Art

Cranes, digger derricks, and other heavy equipment utilize a boom assembly, a load line, and a winch to lift heavy loads. The winch is typically disposed on a base, and the load line runs from the winch along the boom assembly to an implement at the distal end of the boom. The implement then routes the load line downward so as to allow a load to be attached thereto. The winch may then be operated to reduce the available length of the load line and therefore lift the load. The boom assembly can deflect slightly under certain heavy loads. As a distal end of the boom assembly deflects downward, the load line can contact a top side of the boom assembly.

The load line contacting the top side of the boom assembly is undesirable and potentially dangerous for a few reasons. First, longitudinal movement of the load line along the boom assembly (such as by letting out or drawing in the winch) causes excessive friction to the load line as it travels along the boom assembly. Second, the load line can snap onto either a left or a right side of the boom assembly. This snapping is potentially very dangerous because it can cause a small but sudden drop of the load. This drop can cause a failure in the load line or the boom assembly.

SUMMARY

Embodiments of the invention solve the above-mentioned problems by providing a load line guide that provides for convenient and secure alignment of the load line with the boom assembly. The load line guide prevents the contact between the load line and the deflecting boom assembly. The load line guide eases and reduces friction during letting out and taking in of the load line via the winch. The load line guide also prevents the snapping to either side of the boom assembly and thereby makes operation of the crane safer. Further, the load line guide allows for the load line to be placed into the load line guide by simply applying the load line to a top portion of the load line guide. The weight of the load line applies a force that allows the load line to enter into a gap in the load line guide and thereby be secured within the load line guide. The load line can then be selectively removed from the load line guide by actuating a guide cam of the load line guide. Therefore the load line can be loaded into and removed from the load line guide using neither tools nor by feeding an end of the load line guide through the load line guide.

A first embodiment of the invention is directed to a load line guide configured to direct a load line of an crane along a boom assembly, the load line guide comprising a guide housing and a first guide cam. The guide housing presents a gap oriented in a lateral direction and a channel oriented in a longitudinal direction. The first guide cam is pivotably secured to the guide housing and disposed in the gap. The first guide cam is configured to be selectively placed into an open position and a closed position. While the first guide cam is in the open position, the load line guide is configured to receive the load line into the channel of the guide housing; and while the first guide cam is in the closed position, the guide housing is configured to retain the load line guide within the channel of the guide housing.

A second embodiment is directed to a crane comprising a base, a boom assembly, a winch, and a load line guide. The boom assembly presents a proximal end and a distal end, wherein the proximal end of the boom assembly is pivotably secured to the base, and wherein the distal end of the boom assembly presents an implement. The winch selectively releases a load line to be used in conjunction with the implement. The load line guide is secured to the boom assembly configured to keep the load line aligned from the winch to the implement. The load line guide is configured be selectively placed into an open position and a default closed position. The load line guide is configured to receive the load line by applying a downward force from the load line onto the load line guide. The load line guide is also configured to keep the load line aligned with the boom assembly during a deflection of the boom assembly due to a heavy load.

A third embodiment is directed to a method of directing a load line on a crane, the method comprising the following steps: passing a load line from a winch of the crane to an implement of a boom assembly of the crane, such that the load line can be used to perform a task; placing the load line into a load line guide while a distal end of the load line is associated with the implement, wherein the load line guide is disposed along the boom assembly between the winch and the implement; and suspending a load from the load line, wherein upon a deflection of the boom assembly due to the load on the load line, the load line guide keeps the load line aligned with the boom assembly.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
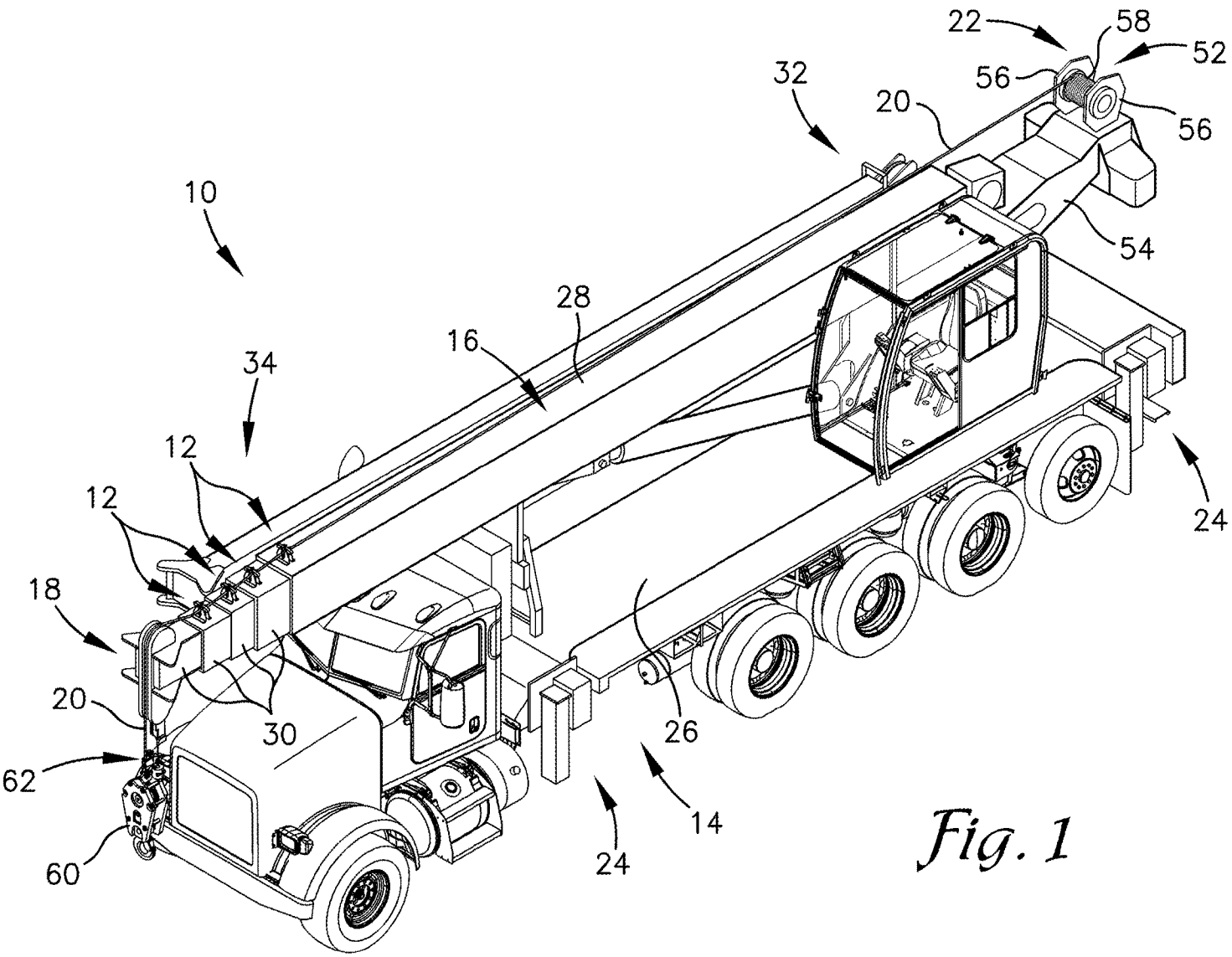
FIG. 1 is a perspective view of a crane with a boom assembly and a set of load line guides disposed thereon.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

A crane 10 utilizing a load line guide 12, constructed in accordance with various embodiments of the invention, is shown in FIG. 1. The crane 10 generally comprises a base 14 with a boom assembly 16 rotatably mounted thereto. An implement 18 for performing work is disposed on the boom assembly 16 to facilitate the accomplishment of a task by a utility worker. At least one load line guide 12 is secured to the boom assembly 16 for securing a load line 20 running from a winch 22 to the implement 18.

The base 14 of the crane 10 is a selectively stabilized platform. In embodiments of the invention, the base 14 is a crane chassis (as illustrated in FIG. 1), a utility truck, an oil rig, an earth-working machine, or a fixed structure. The base 14 provides stability and a counterweight to a load being supported by the boom assembly 16. Larger loads typically require a more stable and a heavier base 14. To achieve this stability, in embodiments of the invention, the base 14 may utilize outriggers 24 or other hydraulic stabilizers. The base 14 may also present a deck 26 upon which the operator can stand to assist the operator in performing the task.

The boom assembly 16 broadly comprises an outer boom section 28 and at least one inner boom section 30. The boom assembly 16 presents a proximal end 32 and a distal end 34. The proximal end 32 is rotatably and/or pivotably secured to a portion of the base 14. The distal end 34 is secured to the implement 18. The at least one inner boom section 30 is at least in part disposed within the outer boom section 28. The at least one inner boom section 30 telescopes to extend or retract into the outer boom section 28. In embodiments of the invention, the boom assembly 16 may comprise additional equipment including any of the following: power lines for the routing of hydraulic, pneumatic, or electrical power; communication wires for user-controls located on the boom assembly 16; and the like. In some embodiments of the invention, the boom assembly 16 comprises a first boom section that rotatably secured to the base 14 and a second boom section rotatably secured to a distal end of the first boom section (not illustrated). In still other boom assemblies, a combination of the telescoping and pivoting boom sections is utilized.

Figure 2:
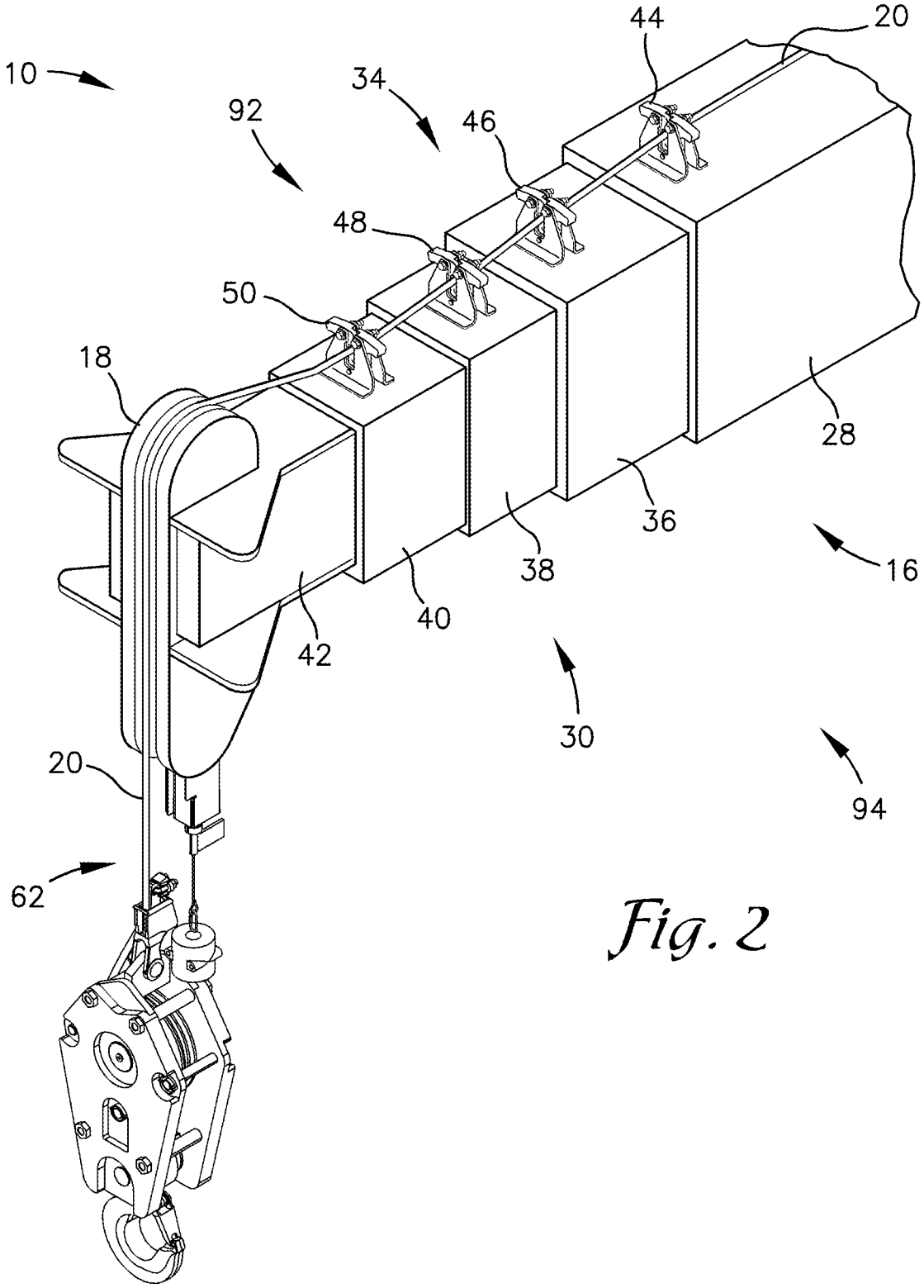
FIG. 2 is a perspective view of the crane of FIG. 1, providing a detailed view of the set of load line guides.

The at least one inner boom section 30 may telescope into a plurality of positions with respect to the outer boom section 28, including a fully retracted position, in which the length of the body of the at least one inner boom section 30 is substantially inserted within the outer boom section 28 (as illustrated in FIGS. 1 and 2), and a fully extended position, in which only a relatively small portion of the length of the body of the at least one inner boom section 30 is inserted within the outer boom section 28 (not illustrated).

In embodiments of the invention, such as illustrated in FIG. 2, the boom assembly 16 comprises the outer boom section 28, a first inner boom section 36, a second inner boom section 38, a third inner boom section 40, and a fourth inner boom section 42. In these embodiments, the crane 10 may further include an outer-boom load line guide secured to the outer boom section 28, a first-inner-boom load line guide 46 secured to the first inner boom section 36, a second-inner-boom load line guide 48 secured to the second inner boom section 38, and a third-inner-boom load line guide 50 secured to the third inner boom section 40. In some embodiments, such as illustrated in FIG. 2, the fourth inner boom section 42 does not include a load line guide 12 secured thereto. The fourth inner boom section 42 includes the implement 18 secured thereto. The implement 18 directs the load line 20 downward such that it can be secured to the load.

The outer-boom load line guide 44, the first-inner-boom load line guide 46, the second-inner-boom load line guide 48, and the third-inner-boom load line guide 50 are disposed near one another while the boom assembly 16 is in the fully retracted position (as illustrated in FIG. 2). These load line guides 12 will become spread out longitudinally as the boom assembly 16 elongates. The load line guides 12 keep the load line 20 aligned with the boom assembly 16 during a heavy load being disposed on the load line 20.

Returning to FIG. 1, the winch 22 is disposed on the boom assembly 16 for selectively releasing the load line 20 to be used in conjunction with the implement 18. The winch 22 is disposed at the proximal end 32 of the boom assembly 16 so as to keep the winch 22 aligned with the boom assembly 16 while the boom assembly 16 rotates about the base 14. The winch 22 includes a spool 52 and a winch support 54. The spool 52 includes two end caps 56 and a central section 58. The load line 20 is wrapped around the central section and prevented from falling therefrom by the two endcaps. A hydraulic motor or other actuator spins the spool 52 so as to let out or take in the load line 20. The load line 20 includes a heavy terminal hook 60 disposed beyond the implement 18. The terminal hook 60 therefore pulls the load line 20 to elongate upon the hydraulic motor spinning the spool 52 in an elongating direction. The hydraulic motor takes in the load line 20 by spinning the spool 52 in a shortening direction. The hydraulic motor is therefore strong enough to lift the load by shortening the load line 20 while the load is attached to the load line 20 through the implement 18 and through the at least one load line guide 12.

In embodiments of the invention, the load line 20 is a long steel cable, or other long metallic cable. The load line 20 is capable of supporting very large loads without breakage, failure, or substantial deformation. An exemplary load line 20 can weigh approximately one pound per foot of length and be ⅝ inch in diameter. The load line 20 is also resistant to surface abrasions. Nonetheless, repetitive contact between the load line 20 and a static metallic component can cause wear and failure to the load line 20. This is due to both frictional contacts during elongation and shortening and static contact while a static amount of the load line 20 has been let out. For these reasons, as discussed below, embodiments of the invention include at least a portion of the load line guide 12 being formed of a polymeric material so as to reduce wear on the load line 20.

The load line guide 12 is secured to the boom assembly 16 and configured to keep the load line 20 aligned from the winch 22 to the implement 18. The load line guide 12 therefore prevents the above-mentioned problems in the prior art of the load line 20 contacting the boom assembly 16 while the boom assembly 16 is deflecting downward due to a heavy load. The load line guide 12 is configured to keep the load line 20 aligned with the boom assembly 16 during a deflection of the boom assembly 16 due to a heavy load. The load line guide 12 is also configured to receive the load line 20 along a length of the load line 20. The utility worker need not place a distal end 62 of the load line 20 through the load line guide 12, essentially threading a needle. This is desirable for a few reasons. First, the distal end 62 of the load line 20 typically has the terminal hook 60 or other device secured at the end. Second, as discussed above, the load line 20 is very heavy, such that "threading the needle" through the load line guide 12 would be very difficult.

Figure 3:
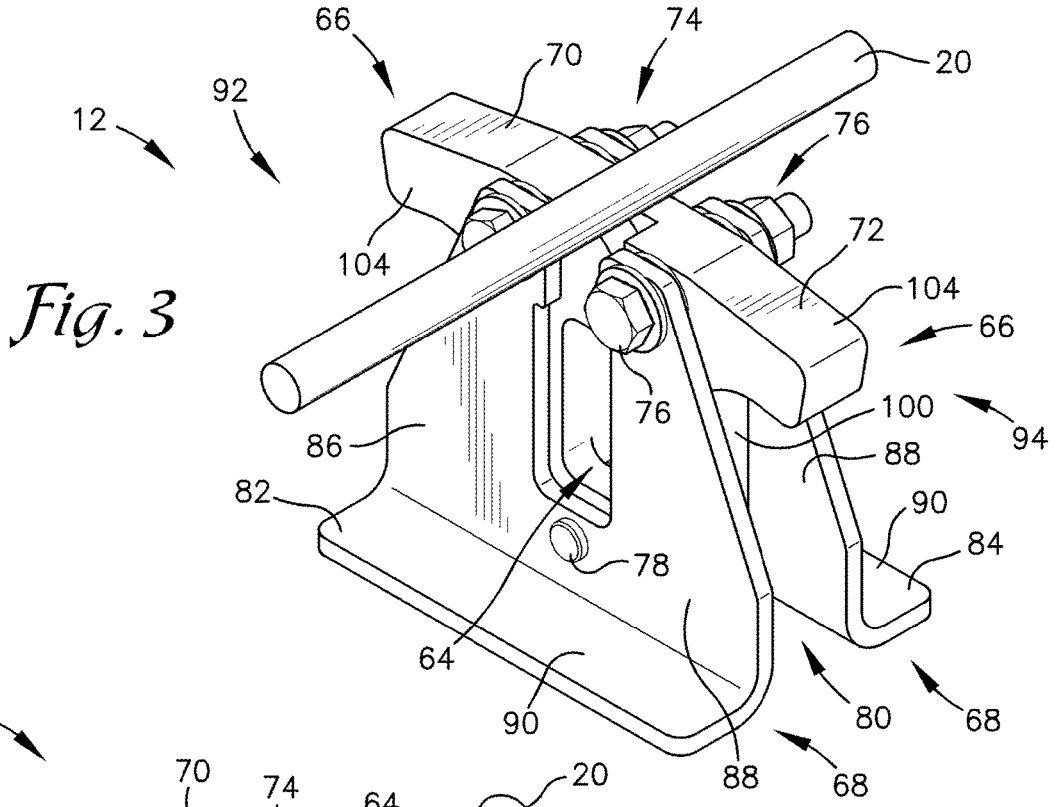
FIG. 3 is a perspective view of a load line guide in a closed position with a load line beginning applying a downward force so as to force the load line guide to the open position.
Figure 4:
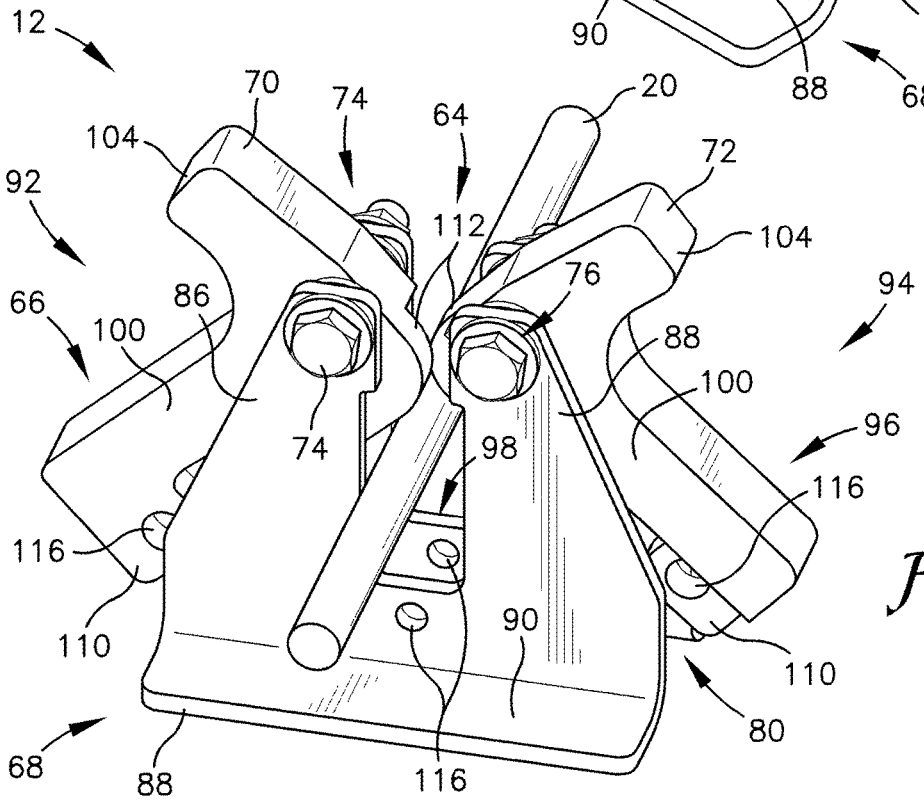
FIG. 4 is a perspective view of the load line guide of FIG. 3, showing the load line having forced its way through two guide cams of the load line guide.
Figure 5:
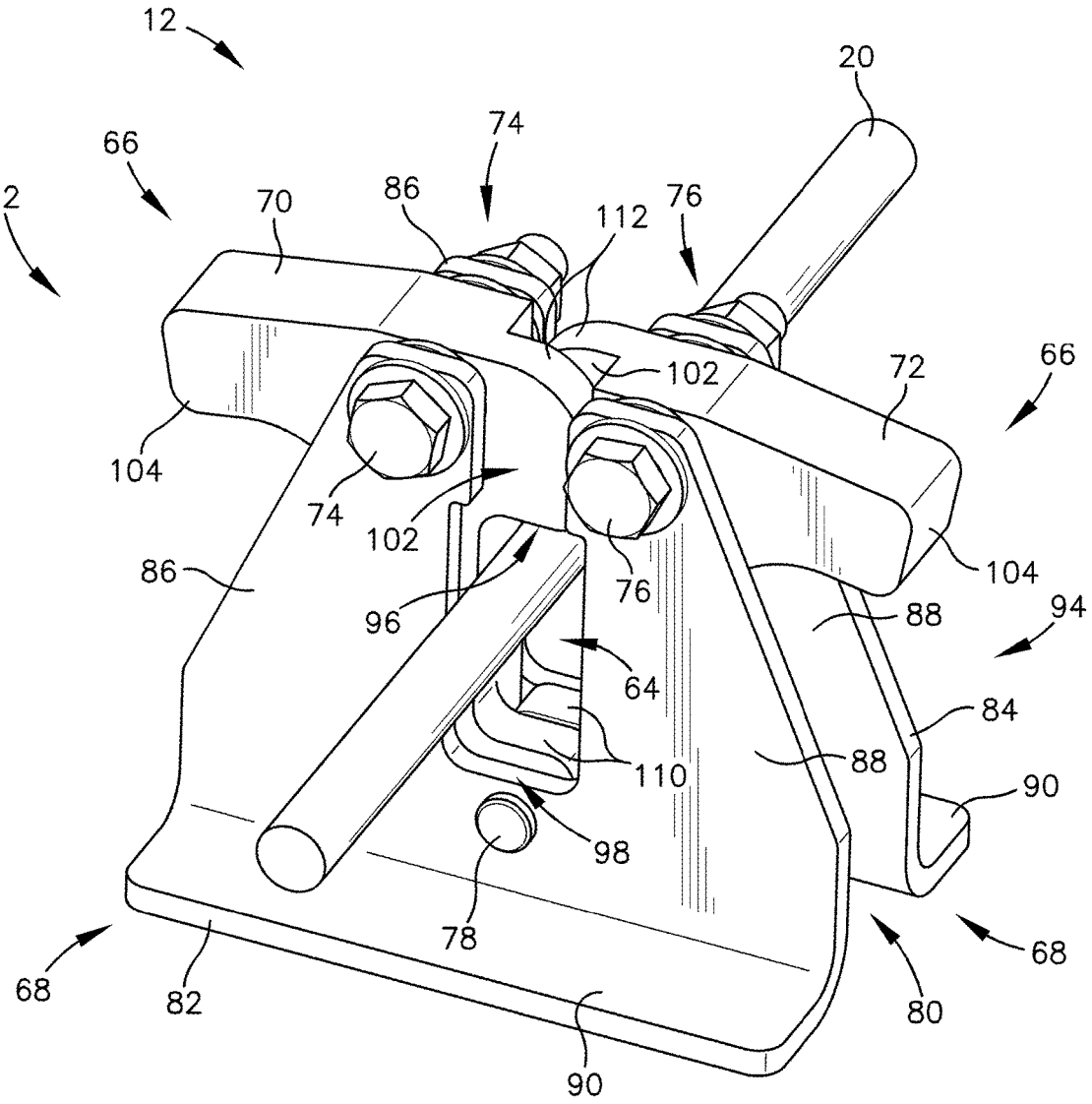
FIG. 5 is a perspective view of the load line guide of FIG. 4, showing the guide cams of the load line guide returning automatically to the closed position.

Turning now to FIGS. 3-5, in embodiments of the invention the load line guide 12 is configured be selectively placed into an open position and a default closed position. The load line guide 12 is configured to receive the load line 20 by applying a downward force from the load line 20 onto the load line guide 12, as illustrated in FIG. 2 (It should be noted that while the load is not illustrated in FIG. 2, the load would be disposed from the terminal hook 60). This downward force moves the load line guide 12 from the closed position to the open position, as illustrated in FIGS. 3-4. The downward force pushes the load line guide 12 into the open position so as to allow the load line 20 to pass into a channel 64 of the load line guide 12. The load line 20 passes into the channel 64 along a length of the load line 20 (i.e. not from an end), as illustrated in FIGS. 3-4. The load line guide 12 then automatically returns to the default closed position once the load line 20 is disposed in the channel 64. This may be accomplished by allowing the weight of a set of guide cams 66 to fall back down to their lowest position (i.e., the closed position). It may additionally or in the alternative be accomplished via hydraulic cylinders, springs, or other actuators. Further, the load line guide 12 is configured to return to the open position and thereby release the load line 20 from the channel 64 by the operator physically manipulating a guide cam of the load line guide 12.

The components of the load line guide 12 will now be discussed in greater detail. In some embodiments of the invention, the load line guide 12 generally comprises a guide housing 68 and a first guide cam 70. In some embodiments of the invention, the load line guide 12 generally comprises the guide housing 68, the first guide cam 70, and a second guide cam 72. Embodiments of the load line guide 12 may further comprise a first pivot fastener 74 for allowing the first guide cam 70 to pivot relative to the guide housing 68, a second pivot fastener 76 for allowing the second guide cam 72 to pivot relative to the guide housing 68, and a lock pin 78 for securing the load line guide 12 in the closed position.

The guide housing 68 presents a gap 80 oriented in a lateral direction (i.e. substantially perpendicular to the orientation of the boom assembly 16) and the channel 64 oriented in a longitudinal direction (i.e. substantially parallel to the orientation of the boom assembly 16). The gap 80 is configured to receive the first guide cam 70 and/or the second guide cam 72 therein and to allow the guide cam to pivot therein between the open position and the closed position. The channel 64 is configured to receive and secure the load line 20 therein. The channel 64, in conjunction with the first guide cam 70 and/or the second guide cam 72, retains the load line 20 to prevent the load line 20 from exiting the load line guide 12.

Figure 6:
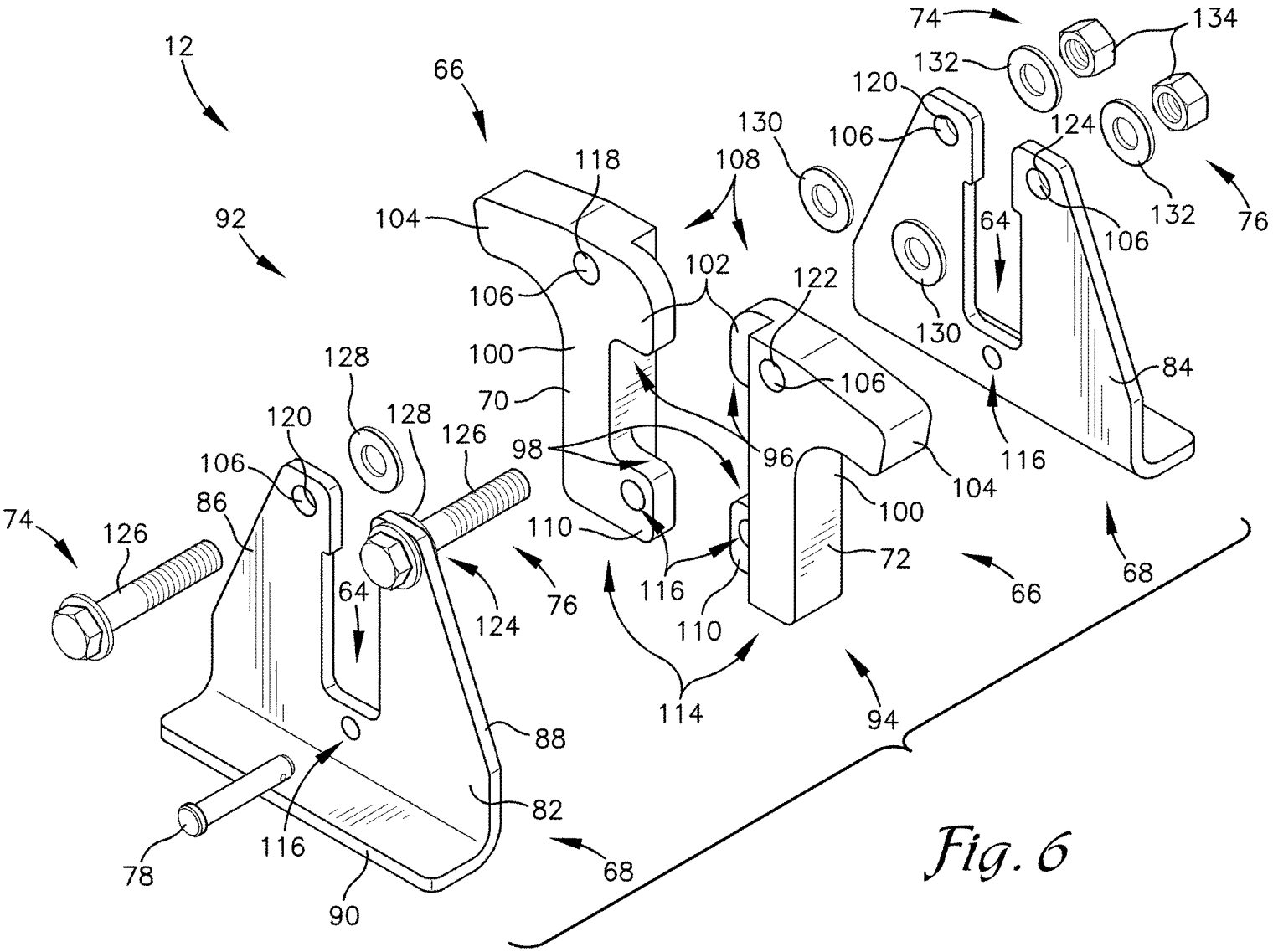
FIG. 6 is an exploded view of the components of the load line guide.

In embodiments of the invention, the guide housing 68 comprises a distal guide-housing segment 82 and a proximal guide-housing segment 84. The distal guide-housing segment 82 is spaced from the proximal guide-housing segment 84 so as to present the gap 80 therebetween. In embodiments of the invention, such as illustrated in FIG. 6, the distal guide-housing segment 82 is separate and distinct from the proximal guide-housing segment 84. As can be seen in FIG. 6, in embodiments of the invention, the distal guide-housing segment 82 is substantially similar in size and shape to the proximal guide-housing segment 84. This provides an advantage in that the guide housing 68 is formed of two identical components, which reduces the size and number of parts that must be kept on hand or ordered by the operator. The respective guide-housing segments 82, 84 also stack nicely together for storage when not installed on the boom assembly 16.

It should be appreciated that "distal" and "proximal" as used herein refer to the boom assembly 16. The distal guide-housing segment 82 is secured closer to the distal end 34 of the boom assembly 16, and the proximal guide-housing segment 84 is secured closer to the proximal end 32 of the boom assembly 16. However, it should be appreciated that in embodiments of the invention, such as illustrated in FIGS. 3-6, the load line guide 12 is substantially symmetrical such that it would operate correctly in substantially the manner if the load line guide 12 were rotated 180 degrees about a vertical axis. The terms "distal" and "proximal" are therefore used herein to orient the reader and not intended to limit the invention.

In embodiments of the invention, each of the distal guide-housing segment 82 and the proximal guide-housing segment 84 comprises a first-side vertical plate 86, a second-side vertical plate 88, and a horizontal plate 90. The first-side vertical plate 86, the second-side vertical plate 88, and the horizontal plate 90 are monolithic. The first guide cam 70 is secured between the first-side vertical plate 86 of the distal guide-housing segment 82 and the first-side vertical plate 86 of the proximal guide-housing segment 84 (i.e., in the gap 80). The second guide cam 72 is secured between the second-side vertical plate 88 of the distal guide-housing segment 82 and the second-side vertical plate 88 of the proximal guide-housing segment 84 (i.e., in the gap 80).

In embodiments of the invention, the proximal guide-housing segment 84 and the distal guide-housing segment 82 each present a general open top A-shape when viewed from either longitudinal direction (i.e., from the proximal end 32 of the boom assembly 16 or the distal end 34 of the boom assembly 16). The set of guide cams 66 selectively provide a top to the A-shape so as to retain the load line 20 therein, based upon the position of the load line guide 12. The channel 64 into which the load line 20 is placed is disposed between the first-side vertical plate 86 and the second-side vertical plate 88.

The horizontal plate 90 of the respective guide-housing segments 82, 84 is configured to be secured to the boom assembly 16. The horizontal plate 90 provides a flat and stable securement point for the load line guide 12. The horizontal plate 90 may be directly secured to the boom assembly 16, such as by welding, or may be secured by fasteners (not illustrated) or by other structures and methods. In some embodiments, not illustrated, the horizontal plate 90 is monolithic with the boom assembly 16 itself, such that the horizontal plate 90 is, in essence, a segment of the boom assembly 16. In these embodiments, the guide housing 68 is originally manufactured as a component of the boom assembly 16 and the guide cams 66 may be pivotably secured thereto, as described below.

In other embodiments, the distal guide-housing segment 82 and the proximal guide-housing segment 84 are monolithic. In still other embodiments, the guide housing 68 comprises a first-side guide-housing segment and a second-side guide-housing segment (not illustrated), such that the first-side guide-housing segment is disposed toward a first side 92 of the boom assembly 16 (such as a right side as viewed from the proximal end 32 of the boom assembly 16) and the second-side guide-housing segment is disposed toward a second side 94 of the boom assembly 16 (such as a left side as viewed from the proximal end 32 of the boom assembly 16).

In embodiments of the invention, the first guide cam 70 and the second guide cam 72 are each pivotably secured to the guide housing 68 and disposed in the gap 80 presented by the guide housing 68. The first guide cam 70 and the second guide cam 72 each pivot about their respective pivot fastener 74, 76. Each of the pivot fasteners 74, 76 (as discussed below) is generally aligned with the boom assembly 16. The guide cams 66 therefore pivot about an axis that is generally parallel with the boom assembly 16.

In embodiments of the invention, the first guide cam 70 and the second guide cam 72 are each individually configured to be selectively placed into the open position and the closed position. While the first guide cam 70 and the second guide cam 72 are each in the open position, the load line guide 12 is configured to receive the load line 20 into the channel 64 of the guide housing 68. While the first guide cam 70 and/or the second guide cam 72 is in the closed position, the guide housing 68 is configured to retain the load line guide 12 within the channel 64 of the guide housing 68. The first guide cam 70 and the second guide cam 72 move independently from one another.

The first guide cam 70 is disposed toward the first side 92 of the guide housing 68 and the second guide cam 72 is disposed toward the second side 94 of the guide housing 68. While the load line 20 is disposed within the load line guide 12, as illustrated in FIG. 5, the first guide cam 70 surrounds the load line 20 on three sides: a top side 96, a bottom side 98, and the first side 92. Similarly, the second guide cam 72 surrounds the load line 20 on three sides: the top side 92, the bottom side 94, and the second side 94. The combination of the first guide cam 70 and the second guide cam 72 therefore surround the load line 20 on all sides while the load line 20 is disposed in the load line guide 12, as illustrated in FIG. 5.

In embodiments of the invention, both the first guide cam 70 and the second guide cam 72 are formed of a polymer, such as an ultra-high-molecular-weight polyethylene (UHMW) plastic. Because the first guide cam 70 and the second guide cam 72 fully surround the load line 20 while the load line 20 is disposed in the load line guide 12, the first guide cam 70 and the second guide cam 72 are configured to contact the load line guide 12 should the load line 20 be pulled out of parallel with the boom assembly 16 for any of various reasons. The first guide cam 70 and second guide cam 72 are not sacrificial, but are designed to be worn rather than the load line 20 (which could cause expensive and dangerous conditions). In embodiments of the invention, the guide housing 68 is formed of a metal. The metal of the guide housing 68 provides structural support for the first guide cam 70 and the second guide cam 72. The metal of the guide housing 68 also allows the guide housing 68 to be secured to the boom assembly 16 (which is also typically formed of metal).

In other embodiments, such as in which the inner boom segment of the boom assembly 16 is formed of a polymer, the guide housing 68, the first guide cam 70, and the second guide cam 72 may all be formed of a polymer. In some embodiments, the guide housing 68 may be formed of a material dependent upon the material composition of the respective boom section 28, 30 to which it is configured to be attached. For example, the crane 10 may include a first load line guide formed at least in part of metal for use with the outer boom section 28 (such as the outer-boom load line guide 44), and a second load line guide formed of a polymeric material for use with the inner boom section 30 (such as the first-inner-boom load line guide 46, the second-inner-boom load line guide 48, and/or the third-inner-boom load line guide 50).

The components of each guide cam 66 will now be discussed in greater detail. In embodiments of the invention, each guide cam 66 is substantially T-shaped. Each guide cam generally comprises a cam body 100, an interlocking protrusion 102, and a lever protrusion 104. The cam body 100 is oriented vertically and presents a pivot opening 106 toward a top end 108 of the guide cam. The interlocking protrusion 102 extends substantially laterally from the cam body 100 toward the channel 64 (i.e., inward). The lever protrusion 104 extends substantially laterally from the cam body 100 away from the channel 64 (i.e., outward from the load line guide 12). The guide cam may also present a pin protrusion 110 for receiving the lock pin 78.

The cam body 100 is configured to contact the load line guide 12 along either the first side 92 or the second side 94 (depending on whether the cam body 100 in question is a component of the first guide cam 70 or the second guide cam 72). The cam body 100 is also configured to withstand large forces being imparted on it by the load line 20. As discussed above, the downward deflection of the boom assembly 16 under a great load can cause the load line 20 to snap toward the first side 92 or the second side 94. The cam body 100 therefore prevents the load line 20 from snapping in the respective direction. The cam body 100 is therefore robust enough to withstand these forces placed upon it by the load line 20 without failing or doing damage to the load line 20. It should also be appreciated that upon a failure of the guide cam, the load line 20 would next contact the guide housing 68.

The interlocking protrusion 102 extends laterally from the cam body 100 into the channel 64 of the guide housing 68. The interlocking protrusion 102 therefore prevents the load line 20 from escaping from the channel 64 while the load line guide 12 is in the closed position, as illustrated in FIG. 5. It should be appreciated that either the interlocking protrusion 102 on the first guide cam 70 or the interlocking protrusion 102 on the second guide cam 72 could prevent the load line 20 from escaping the channel 64. This provides redundancy, such that the load line 20 would still be retained within the channel 64 even in the event of either guide cam 66 failing.

In embodiments of the invention, the interlocking protrusions 102 overlap to both independently perform this redundancy function. For example, as seen in FIG. 6, the interlocking protrusion 102 of the first guide cam 70 is oriented toward the distal guide-housing segment 82, and the interlocking protrusion 102 of the second guide cam 72 is oriented toward the proximal guide-housing segment 84. As such, in embodiments of the invention, the interlocking protrusions 102 are substantially half, or less than substantially half of a thickness of the cam body 100 (which is the same as or slightly less than the gap 80 between the distal guide-housing segment 82 and the proximal guide-housing segment 84). The interlocking protrusion 102 of the first guide cam 70 overlaps the interlocking protrusion 102 of the second guide cam 72 while the first guide cam 70 and the second guide cam 72 are in the closed position.

In embodiments of the invention, the interlocking protrusions 102 present an arcuate top edge 112. The arcuate top edge 112 is configured to allow the load line 20 to nest therein such that the load line 20 will place the above-discussed downward force onto the interlocking protrusions 102. The arcuate top edge 112 also allows the load line 20 to pass into the channel 64 past the respective interlocking protrusions 102 when the load line guide 12 is in the open position, as illustrated in FIG. 4.

The lever protrusion 104 extends laterally from the cam body 100 away from said channel 64 of the guide housing 68 such that it can be manually operated. As can be appreciated from FIGS. 3-4, the first guide cam 70 and the second guide cam 72 can be placed into the open position by pushing upward on the lever protrusion 104. It can also be appreciated that manually operating either lever protrusion 104 in isolation will not place the load line guide 12 in the open position. Rather, both the lever protrusion 104 of the first guide cam 70 and the lever protrusion 104 of the second guide cam 72 must each be manually operated simultaneously to place the load line guide 12 in the open position (such as illustrated in FIG. 4). This prevents incidental release of the load line 20, such as by bumping one of the lever protrusions 104 against an external object or the like. The lever protrusion 104 of the first guide cam 70 and the lever protrusion 104 of the second guide cam 72 are configured to be manually actuated by the operator to remove the load line 20 from the load line guide 12 by actuating the lever protrusion 104 so as to pivot the first guide cam 70 and the second guide cam 72 into the open position. In this way the load line 20 can then be physically removed by pulling the load line 20 out of the channel 64 or allowing the load line 20 to exit the channel 64 under its own forces. It should be noted that for safety reasons, the operator may be instructed to release both guide cams 66 from below the boom assembly 16. In that way, if the load line 20 should release or snap out of the channel 64 violently, the operator will not be in a position to be struck by the load line 20 (as he or she would be if situated above the load line guide 12).

In embodiments of the invention, the first guide cam 70 and the second guide cam 72 each present the pin protrusion 110 toward a bottom end 114. The pin protrusion 110 presents a pin opening 116 that is configured to receive the lock pin 78 therethrough. The pit protrusion is disposed toward a bottom end of the cam body 100 and oriented inward. In embodiments of the invention, such as illustrated in FIG. 5, the pin protrusions 110 of the first guide cam 70 and the second guide cam 72 overlap and interlock (similarly to the interlocking protrusions 102).

Similarly, in embodiments of the invention, the distal guide-housing segment 82 and/or the proximal guide-housing segment 84 present the pin opening 116 configured to receive the lock pin 78 therethrough. The pin opening 116 is disposed in the distal guide-housing segment 82 and the proximal guide-housing segment 84 such that the lock pin 78 traversing therebetween will lock the guide cams 66 in place to prevent an undesired actuation of the guide cams 66 (as discussed below). The pin opening 116 is typically disposed between (i.e., at an intersection of) the first-side vertical plate 86 and the second-side vertical plate 88 of the respective guide-housing segments 82, 84. In other embodiments, in addition or in the alternative a hydraulic cylinder, spring, or other actuator applies a force on at least one guide cam 66 to prevent the load line guide 12 from returning to the open position.

While the load line guide 12 is in the closed position (such as in FIG. 3 and FIG. 5), the pin opening 116 of the first guide cam 70, the pin opening 116 of the second guide cam 72, and the pin opening 116 of the guide housing 68 are all substantially aligned. This allows for the lock pin 78 to be emplaced through the collective pin opening 116. The lock pin 78 may then be secured in the pin opening 116 to prevent unintended or incidental removal of the lock pin 78. The lock pin 78 prevents the load line guide 12 from leaving the closed position while the lock pin 78 is in the pin opening 116. The lock pin 78 is therefore a secondary feature that prevents unintended release of the load line guide 12 in addition to the redundant strength provided by the first guide cam 70 and the second guide cam 72, in that either will prevent the load line 20 from escaping.

It should be appreciated that in embodiments of the invention, the first guide cam 70 and the second guide cam 72 are substantially identical to each other. As can be seen in FIG. 6, the first guide cam 70 is substantially the same size and shape as the second guide cam 72. The second guide cam 72 is rotated 180 degrees about a vertical axis. These embodiments may present advantages in that the operator, an operating company, or the like need only order and stock a single type of component for the guide cam. This eases the logistical burdens with stocking and supplying the components. As discussed above, embodiments of the guide cams 66 are formed of a polymer. As such, they may be prone to failure due to the repeated friction with the metallic load line 20.

In embodiments of the invention, the first guide cam 70 is pivotably secured to the guide housing 68 via the first pivot fastener 74. The first pivot fastener 74 is disposed through a first pivot opening 118 at the upper end of the first guide cam 70 and through a corresponding first pivot opening 120 in the guide housing 68. Similarly, the second guide cam 72 is pivotably secured to the guide housing 68 via the second pivot fastener 76. The second pivot fastener 76 is disposed through a second pivot opening 122 at the upper end of the second guide cam 72 and through a corresponding second pivot opening 124 in the guide housing 68. It should be appreciated that in embodiments of the invention, each pivot fastener 74, 76 passes through both the distal guide-housing segment 82 and the proximal guide-housing segment 84, as illustrated in FIGS. 3-6. The first pivot fastener 74 and the second pivot fastener 76 each allow their respective guide cams 66 to pivot upward and downward perpendicular to the load line 20 and the boom assembly 16. The first pivot fastener 74, the second pivot fastener 76, and the boom assembly 16 therefore are each substantially parallel with each other.

In embodiments of the invention as illustrated in FIG. 6, each of the pivot fasteners 74, 76 further includes a pivot bolt 126, a distal pivot washer 128, a proximal pivot washer 130, a proximal securing washer 132, and a securing nut 134. The various components of the pivot fasteners 74, 76 may be arranged as can be see in FIG. 6. The various components keep the pivot fasteners 74, 76 secured while allowing the guide cams 66 to pivot therein.

The pivot bolt 126 actually traverses the pivot openings 106. The distal pivot washer 128 and the proximal pivot washer 130 allow the guide cam 66 to easily and freely rotate between the open and the closed position. The proximal securing washer 132 and the securing nut 134 prevent the pivot bolt 126 from falling out of the pivot openings 106. However, the proximal securing washer 132 and the securing nut 134 allow for the operator to easily and quickly change out a worn or damaged guide cam 66 by applying a simple tool to release the securing nut 134 from the pivot bolt 126.

Because, as discussed above, embodiments of the guide cam 66 are formed of a polymer that is repeatedly susceptible to wear against a metallic load line 20, this ability to quickly and easily exchange worn or damaged guide cams 66 may be advantageous in keeping the load line guide 12 working efficiently. Further, the operator may be able to exchange the guide cams 66 based upon a type of load line 20 that is being utilized. For example, heavy duty load lines 20 may cause more damage to guide cams 66. Therefore, these load lines 20 may be utilized with a metal or hardened polymer guide cams 66 that may damage smaller load lines 20.

A method of installing the load line guide 12 onto the crane 10 will now be discussed. The method comprises the following steps: acquiring the distal guide-housing segment 82 and the proximal guide-housing segment 84 (these components may be substantially identical, as can be seen in FIG. 6); securing the horizontal plate 90 of the distal guide-housing segment 82 and the horizontal plate 90 of the proximal guide-housing segment 84 to a distal end of a boom section, such that the gap 80 is disposed therebetween; inserting the first guide cam 70 into the gap 80 such that the first pivot openings 118, 120 are aligned; inserting the first pivot fastener 74 into the first pivot opening 118, 120; inserting the second guide cam 72 into the gap 80 such that the second pivot openings 122, 124 are aligned; and inserting the second pivot fastener 76 into the second pivot opening 122, 124.

A method of using the load line guide 12 includes the following steps: placing the load line 20 against the arcuate top segments of the guide cams 66; applying a downward force on the guide cams 66 (either manually or via the weight of the load line 20); allowing the load line 20 to push the load line guide 12 temporarily into the open position; allowing the load line guide 12 to return to the closed position automatically.

It should be appreciated that while the above description is directed to the crane 10*s* and other heavy equipment, these are merely an exemplary field of use for the invention. Other embodiments of the invention can be utilized for keeping virtually any line, rope, or cable aligned with any boom or other structure. For example, other various cables and hoses, which are common on cranes 10 and other utility vehicles, may be configured to be retained in place and aligned using the load line guide 12. Keeping hydraulic lines, fiber optic lines, electrical lines, and the like aligned and straight on the vehicle can be difficult. The load line guide 12 allows the operator to therefore easily and selectively run and secure these lines in place.

As another example, some embodiments of the invention are directed toward fishing poles. The load line guide 12 is configured to be installed on a fishing pole to accept the fishing line therein. In this way, the operator can easily and quickly string their fishing pole without having to "thread the needle" as is common in the prior art. This may be advantageous to the field of fishing poles because fishing line has a tendency to tangle and become snared. Embodiments of the invention will therefore aid in correcting these issues.

As yet another example, some embodiments of the invention are directed to jib assemblies. Jib assemblies are also commonly used for video cameras, because they facilitate shots not possible to a person holding a video camera, such as sweeping shots and high angle shots. Keeping the power and data cables aligned with the jib assembly, such that the do not become fouled, obstruct movement, or obstruct the shot, could be performed via the load line guide 12 as described above.

As yet a further example, embodiments of the invention may be directed to hanging cables from a structure, such as Christmas lights. The load line guide 12 could be permanently or selectively secured to the structure (such as a house) and the electrical wiring for the Christmas light easily inserted into the load line guide 12 to facilitate the installation and uninstallation of the Christmas lights. Similarly, other cables could be so installed and uninstalled on the structure.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A load line guide configured to direct a load line of a crane along a boom assembly, the load line guide comprising:

a guide housing presenting a gap oriented in a lateral direction and a channel oriented in a longitudinal direction; and a guide cam pivotably secured with a pivot fastener to the guide housing and disposed in the gap, wherein said guide cam is configured to be selectively placed into an open position and a closed position, wherein while the guide cam is in the open position, the load line guide is configured to receive the load line into the channel of the guide housing, wherein the guide cam is configured to temporarily pivot about the pivot fastener to the open position when the load line is forced against the guide cam, wherein the guide cam is configured to pivot about the pivot fastener to the closed position when the load line passes the guide cam and the force on the guide cam is removed, wherein while the guide cam is in the closed position, the guide housing is configured to retain the load line within the channel of the guide housing.

2. The load line guide of claim 1, wherein the guide cam is a first guide cam and further comprises:

a second guide cam pivotably secured to the guide housing and disposed in the gap, wherein said second guide cam is configured to be selectively placed into the open position and the closed position, wherein while the second guide cam is in the open position, the load line guide is configured to receive the load line into the channel of the guide housing, wherein while the second guide cam is in the closed position, the guide housing is configured to retain the load line guide within the channel of the guide housing.

3. The load line guide of claim 2, wherein the first guide cam is disposed on a first side of the guide housing, wherein the second guide cam is disposed on a second side of the guide housing, wherein the first guide cam and the second guide cam are formed of a polymer so as to reduce friction induced on the load line as the load line travels through the load line guide.

4. The load line guide of claim 3, wherein the first guide cam and the second guide cam each include:

a cam body oriented substantially vertically;

an interlocking protrusion extending laterally from the cam body into said channel of the guide housing; and a lever protrusion extending laterally from the cam body away from said channel of the guide housing.

5. The load line guide of claim 4, wherein the interlocking protrusion of the first guide cam overlaps the interlocking protrusion of the second guide cam while the first guide cam and the second guide cam are in the closed position.

6. The load line guide of claim 4, wherein a gap is presented between the interlocking protrusion of the first guide cam and the interlocking protrusion of the second guide cam while the first guide cam and the second guide cam are in the open position, such that the load line can pass through the gap.

7. The load line guide of claim 4, wherein the lever protrusion of the first guide cam and the lever protrusion of the second guide cam are configured to be manually actuated by the operator to remove the load line from the load line guide by actuating the lever protrusion so as to pivot the first guide cam and the second guide cam into the open position.

8. The load line guide of claim 4, wherein the interlocking protrusion of the first guide cam and the interlocking protrusion of the second guide cam are configured to pivot the first guide cam and the second guide cam from the closed position to the open position in response to a downward force.

9. The load line guide of claim 8, wherein the load line being placed downward into the load line guide from above provides the downward force.

10. The load line guide of claim 9, wherein the first guide cam and the second guide cam automatically return to the closed position after the load line passes the interlocking protrusion of the first guide cam and the interlocking protrusion of the second guide cam.

11. The load line guide of claim 1, wherein the guide housing comprises:

a distal guide housing segment; and a proximal guide housing segment, wherein the distal guide housing segment is spaced from the proximal guide housing segment so as to present said gap therebetween.

12. The load line guide of claim 11, wherein each of the distal guide housing plate and the proximal guide housing plate comprises:

a first-side vertical plate;

a second-side vertical plate;

wherein said channel is disposed between the first-side vertical plate and the second-side vertical plate;

a lock pin opening configured to receive a lock pin therethrough; and a horizontal plate configured to be secured to the boom assembly.

13. The load line guide of claim 1, wherein the guide cam is pivotably secured to the guide housing via the pivot fastener being disposed through a pivot opening at an upper end of the guide cam, wherein the pivot fastener is also disposed through at least one pivot opening in the guide housing.

14. The load line guide of claim 13, wherein the pivot fastener comprises:

a pivot bolt for traversing said at least one pivot opening;

a distal pivot washer disposed between the guide cam and the guide housing on a distal side;

a proximal pivot washer disposed between the guide cam and the guide housing on a proximal side; and a pivot nut for securing the pivot bolt in the pivot opening, wherein the guide cam can be easily uninstalled and replaced upon becoming damaged at least in part by removing the pivot fastener.

* * * * *